United States Patent [19]

Behr

[11] 4,220,282

[45] Sep. 2, 1980

[54] APPARATUS FOR PAINTING PARTS OF LARGE SURFACE AREA

[76] Inventor: Hans Behr, Lenzhalde 82, Stuttgart 1, Fed. Rep. of Germany, 7000

[21] Appl. No.: 909,341

[22] Filed: May 24, 1978

[30] Foreign Application Priority Data

Jun. 3, 1977 [DE] Fed. Rep. of Germany ..... 2725038

[51] Int. Cl.[2] ..... B05B 3/18

[52] U.S. Cl. ..... 239/187; 118/323

[58] Field of Search ..... 239/187, 186, 184, 224, 239/225, 229, 244, 165, 164; 118/323, 301, 317, 318, 306, 72, 105

[56] References Cited

U.S. PATENT DOCUMENTS

| | | | |
|---|---|---|---|
| 3,286,688 | 11/1966 | Blenman | 239/186 |
| 3,386,414 | 6/1968 | Faber | 239/187 |

*Primary Examiner*—James B. Marbert

*Attorney, Agent, or Firm*—Martin A. Farber

[57] ABSTRACT

An apparatus for painting parts of large surface area, the apparatus having a spray gun movable to and fro, and also rotatable, relative to a part to be painted. The gun is carried by a swivel member rotatably mounted by a cantilever arm which is mounted for rocking motions about first and second axes, one at right angles to the other, and the swivel member and gun being rotatable about a swivel axis which is at right angles to both these first and second axes. The swivel member is an elongated rod parallel to the cantilever arm, the arm being mounted on a rockable shaft, the axis of which is said first axis, the spray gun being mounted on the free end of the swivel rod. A positively actuatable cam control produces rocking motion of the cantilever arm about the second axis; a mechanical coupling couples the swivel rod to the cantilever arm so that rotation of the spray gun is derived from the motion of the cantilever arm about the first axis, which motion moves the spray gun to and fro and is substantially independent of the second axis which moves the spray gun backwards and forwards.

29 Claims, 4 Drawing Figures

APPARATUS FOR PAINTING PARTS OF LARGE SURFACE AREA

This invention relates to an apparatus for painting shaped parts of large surface area, for example car body side panels and doors, the apparatus having a spray gun movable to and fro, for example up and down as well as towards and away, in relation to the part to be painted, and also rotatably adjustable in a generally perpendicular plane in relation to the part.

It is an object of the invention to provide such an apparatus in which the movements of the spray gun can be controlled simply and by virtue of a combination of translation and rotation.

According to this invention the apparatus has a spray gun movable to and fro, and also rotatable, relative to a part to be painted, characterised in that the gun is carried by a swivel member rotatably mounted by a cantilever arm which is mounted for rocking motions about first and second axes, one at right angles to the other, and the swivel member and gun being rotatable about a swivel axis which is at right angles to both the said first and second axes. The spray gun may be arranged at the free end of the swivel member which may be a swivel rod extending parallel to and in the cantilever arm which in turn may be pivoted to a horizontal shaft which is rotatable about the first axis, so that the cantilever arm can be moved about the second axis. A positive cam control may be provided for the motion of the cantilever arm which moves the paint spray gun backwards and forwards, and a mechanical coupling may be provided to couple the swivel rod with the cantilever arm so that rotation of the spray gun is derived from the motion of the cantilever arm about the first axis, which motion moves the spray gun to and fro, for example up and down, and the rotation of the spray gun is substantially independent of the movement which moves the spray gun backwards and forwards. If necessary, rotation of the spray gun may also be derived from the motion which moves the spray gun backwards and forwards and substantially independent of the motion about the first axis which moves the gun up and down. The rockable shaft may, of course, also be arranged with the first axis vertical if the surface of the part to be painted is horizontal. The "upwards and downwards" and "forwards and backwards" motions then become "to and fro" and "up and down" motions.

A preferred embodiment of the apparatus of the invention, in the form of an automatic side sprayer, has an electric motor with a shaft which drives the rockable shaft by way of a cam mechanism. Electric motors of this type are commercially available and the cam mechanism can be adapted to the required purpose.

In the preferred embodiment, the cam mechanism comprises a driven cam disc and a positively actuated roller lever which is fixed on the rockable shaft. This simple cam mechanism allows for a wide variation in layout by choice of the disc shape and the length of the lever.

In the preferred embodiment, the cam disc is replaceable so that the apparatus can be adapted to different purposes. It exerts positive control on the roller lever whose roller is held in contact with the disc by the torque in the driven shaft, which is produced by the weight of the cantilever arm. This positive control thus advantageously makes use of the weight of the cantilever arm.

The preferred embodiment also has a reduction gear between the motor shaft and the cam disc. This reduction gear adjusts the frequency of the rocking shaft to the relatively high speed of commercially available electric motors, so that no special motor, such as a geared motor, is required for driving the rocking shaft. For a change in frequency without changing the cam it is therefore not necessary to replace the electric motor but simply to replace, for example, one pair of wheels of the reduction gear.

In the preferred embodiment, the reduction gear may include a belt drive and a gear transmission although only one of the two may be provided. The advantage of using a combination of the two is however, firstly, that a higher reduction ratio can be obtained with a gear wheel transmission and, secondly, a belt drive provides for easier change of the reduction ratio. Both these features are desirable.

In the preferred embodiment, the belt drive is a change speed gear with several driving and driven pulleys. Such a change speed gear enables the reduction ratio to be changed by adjusting the belt. No tools are required for this.

In the preferred embodiment, the cantilever arm is pivotally connected to the rockable shaft by means of a forked joint in which a trunnion bearing is fixed to one end of the shaft while a trunnion pin, which in the preferred embodiment is divided, connects the cantilever arm to the trunnion bearing. This simple method of pivoting the cantilever arm ensures that it will be securely mounted on the rocking shaft and at the same time renders the motion of the cantilever arm about the axis of the trunnion pins independent of its motion about the longitudinal axis of the rocking shaft.

In the preferred embodiment, the means provided for positively actuated cam control of the cantilever arm comprises a replaceable, stationary cam which extends along a circular arc about the first axis and a rolling body which rolls on the cam and is mounted on the cantilever arm so as to be freely rotatable about an axis parallel to the swivel axis. This cam control is a simple form of positive control of the cantilever arm, particularly if, as in the preferred embodiment, the cam controls the cantilever arm positively, the rolling body is a roller, and the positive connection is produced by a spring connected to the cantilever arm and the frame of the apparatus. The movement of the cantilever arm can be adapted readily to the shape of the part to be painted, which extends in a vertical plane, simply by replacing the curve, so that the spray gun maintains an almost constant distance from the part to be painted, regardless of its height.

In the preferred embodiment, the means provided for mechanically coupling the swivel rod to the cantilever arm is a support rod which is connected to the swivel rod by a hinge joint and is supported by a stationary support bearing, a transmission member which is non-rotatably seated on the swivel rod and acts on the support rod, and a torsion spring acting between the cantilever arm and the transmission member. By this simple arrangement, rotation of the spray gun is derived from the motion of the cantilever arm about the first axis, which motion of the spray gun is up and down, without the backwards and forwards motion of the gun having any significant effect on the rotation. This motion about the second axis may be independent of the two other movements of rotation, the one about the first axis and the other about the swivel axis.

In the preferred embodiment, the supporting bearing for the support rod can be adjusted parallel to the first axis so that the degree to which the swivel rod is coupled to the cantilever arm can be varied by means of the support rod and its supporting bearing. Further, the supporting bearing has a line of support extending transversely to the first axis so that the support rod can slide over the supporting bearing when the cantilever arm is deflected about the second axis. To improve the coupling of the swivel rod with the cantilever arm and influence the coupling, the line of contact may be a non-rectilinear curve which is calculated according to the shape of the part to be painted, or is empirically determined.

In the preferred embodiment, the hinge joint which connects the support rod to the swivel rod has a retaining ring which is mounted on the swivel rod and fixed to the support rod and is secured in its axial position by a setting ring and the transmission member. This transmission member has a securing ring which is mounted on the swivel rod and has a transmission pin parallel to the swivel rod axis, and the torsion spring is a coil spring mounted on the swivel rod and the ends of which bear against the transmission member and the cantilever arm. This form of mechanical coupling connecting the swivel rod to the cantilever arm, in so far as it is not determined by the support rod and supporting bearing, provides a simple means of ensuring that when the retaining ring of the support rod is displaced vertically, the support rod carries the securing ring with it by way of the pin on the securing ring and thereby turns the swivel rod about its axis to tension or relax the coil spring. This takes place virtually independently of any additional horizontal movement of the retaining ring superimposed on its vertical movement when the positive cam control of the cantilever arm causes the spray gun to be moved towards or away from the part to be painted, so long as the spray gun moves to and fro along a circular arc.

In the preferred embodiment, that end of the swivel rod which is remote from the spray gun extends out of the cantilever arm, and the hinge joint, transmission member and coil spring are arranged at that end. The distance of the support rod from the first axis, which distance determines the degree of coupling of the swivel rod to the cantilever arm, thereby becomes as great as possible and all the parts of the apparatus taking part in the coupling become readily accessible for adjustment, servicing or replacement, since they are situated outside the cantilever arm which contains the swivel rod.

In the preferred embodiment, the swivel rod is provided with a crank arm which is acted upon by the piston rod of a ram when the cantilever arm is at its lower reversing point, the crank arm thereby turning the spray gun downwards for cleaning. When this ram, for example a pneumatic ram, is arranged vertically, it need act in only one direction, provided the cylinder chamber containing the pressure fluid is at atmospheric pressure, because the piston is then under the action of gravity.

In the preferred embodiment, a paint changing device is arranged at that end of the cantilever arm near the spray gun, and pipes for supplying this device emerge from the cantilever arm near the rockable shaft. This further feature of the apparatus of the invention has two advantages. Firstly, the loss of paint during cleaning when changing paint is only slight, and secondly the pipes are not subject to bending, stretching or compression to any great extent, so that they have a long service life.

The preferred embodiment of the invention will now be described in more detail by way of example, with reference to the drawings, in which.

Figure 2:
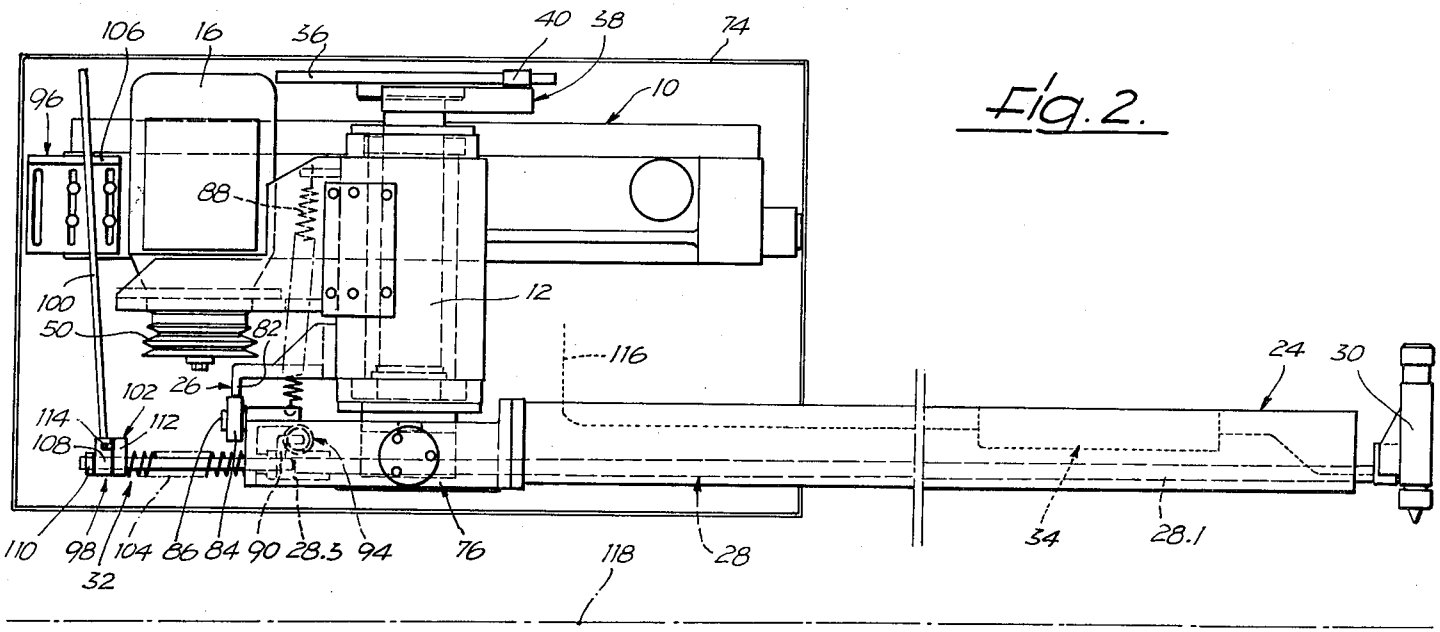
FIG. 2 is a top plan, partly broken away.
Figure 3:
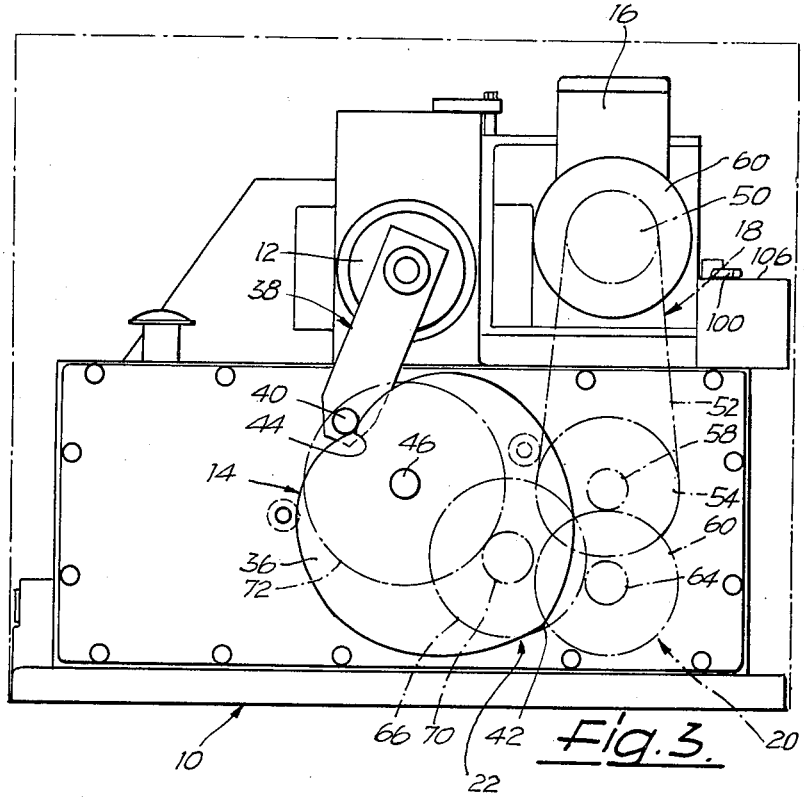
FIG. 3 is a partly diagrammatic rear elevation, without the cantilever arm and spray gun.

Referring to the drawings, an automatic side sprayer will be described only so far as is necessary for explaining the invention. It comprises a frame 10 mounted on a carriage guide so that it can be moved at right angles to the plane of the drawing (FIGS. 1 to 3), a rocking shaft 12 (FIGS. 2 and 3) mounted on the frame with its axis horizontal, a cam 14 (FIG. 3) for driving the shaft, an electric motor 16, a reduction gear transmission 22 between the electric motor and the cam disc, and including a belt drive 18 and a gear transmission 20, a cantilever arm 24 pivotally mounted on the shaft, a positively actuated cam control device 26 for the cantilever arm, a swivel rod 28 which is mounted in the cantilever arm and carries a spray gun 30 whose movement is controllable, a mechanical coupling 32 connecting the swivel rod to the cantilever arm, and a paint changing device 34 in the cantilever arm near the spray gun.

Figure 4:
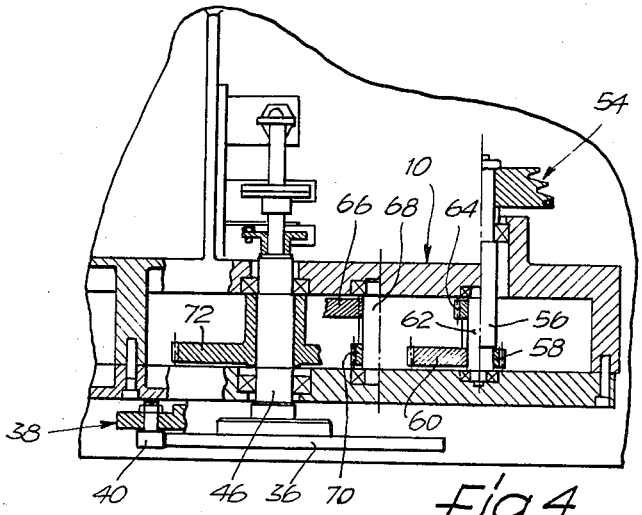
FIG. 4 is a horizontal detail section showing a reduction gear.

The cam 14 has a driven cardioid disc 36 and a positively operated rocker arm 38 which is fixed on the shaft 12. The cam disc 36 is replaceable and positively controls the rocker arm 38 whose follower roller 40 is held in contact with the cam disc by the torque produced in the shaft 12 by the weight of the arm 24, the roller 40 engaging in a depression 44 diametrically opposite the tip 42 of the cam disc when the cantilever arm 24, which is pivotable about the axis of the shaft 12, is at its lower reversing point indicated by the lower dash-dot line in FIG. 1, and in which the spray gun 30 is nearest to the ground. The arm 24 reaches its upper reversing point indicated by the upper dash-dot line after a deflection through approximately 60°, when the cam disc 36 has rotated through 180° and the roller 40 is on the tip 42. The arm 24 is in its horizontal mid position shown in FIGS. 1 and 2 when the cam disc 36 has moved approximately 90° out of its positions of rotation in which the arm 24 is at its reversing points. A horizontal drive shaft 46 (FIGS. 3 and 4) on which the cam disc 36 is mounted, is situated below and parallel to the shaft 12.

The electric motor 16 has a shaft 48 (FIG. 1) which is in continuous rotation when the motor is energised, and on which are mounted drive pulleys 50 of the belt transmission 18, which pulleys selectively rotate one of several driven pulleys 54 of the belt transmission by way of a belt 52, which driven pulleys are mounted on a driven shaft 56 (FIG. 4) whose rotation is transmitted to the drive shaft 46 of the cam disc 36 by way of the gear transmission 20.

The gear transmission 20, which provides the main contribution to the reduction gearing 22, has three pairs of intermeshing gears. The first pair of gears consists of a pinion 58 on the driven shaft 56 and a large spur wheel 60 on an intermediate shaft 62. The second pair consists of a pinion 64 on the intermediate shaft 62 and a large spur wheel 66 on another intermediate shaft 68. The third pair consists of a pinion 70 on the intermediate shaft 68 and a large spur wheel 72 on the drive shaft 46 which (FIG. 4) also serves as a control shaft for electrical remote control of the paint changing device 34.

Figure 1:
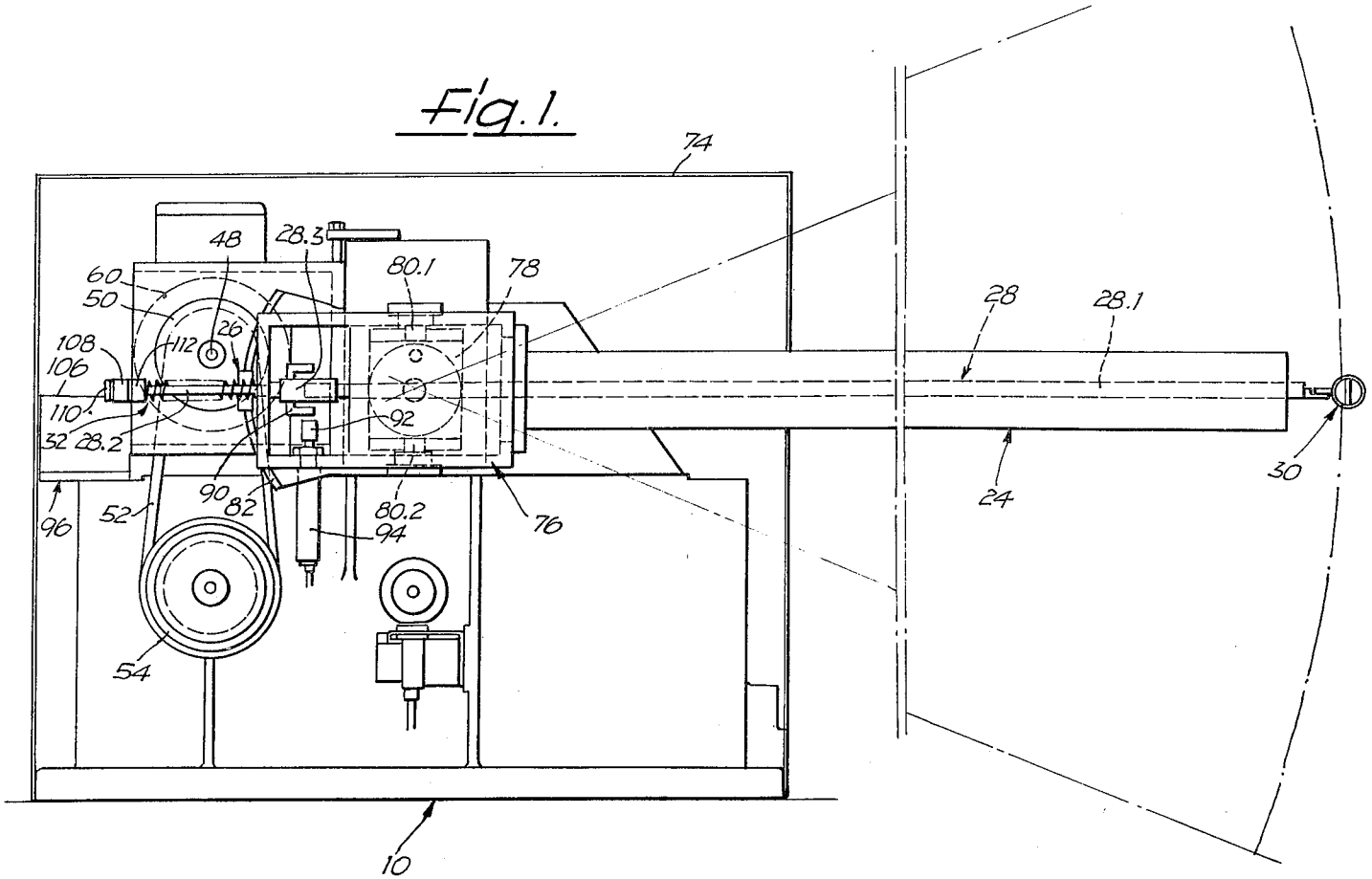
FIG. 1 is a side elevation, partly broken away, of the apparatus as viewed from a part to be sprayed.

The cantilever arm 24 projects through an opening in a housing 72 enclosing the frame 10. This arm 24 includes a multipart tube, rectangular in cross-section, and in which the swivel rod 28 is rotatably mounted by suitable means, not shown. The arm 24 is pivotally mounted on the rocking shaft 12 by a forked joint 76 whose yoke 78 is fixed to one end of the shaft 12 while trunnion pins 80.1 and 80.2 connect the cantilever arm to the parallel side arms of the yoke 78. The common vertical axis of the two pins 80.1 and 80.2 therefore intersects the horizontal axis of the rocking shaft 12 at right angles, FIG. 1. The cantilever arm 24 therefore can be moved to and fro in a horizontal plane about the trunnion pins 80.1 and 80.2, so that the spray gun 30 can be moved towards and away from the part being painted. This action is caused by the cam control device 26. The latter has a replaceable cam 82 which is mounted in a fixed position on the frame 10 and extends arcuately about the axis of the rocking shaft 12 as seen in FIG. 1. Also it has a shape corresponding to that of the part to be painted. Thus the cam 82 may be curved not only as seen in FIG. 1, but may also be curved relative to the plane of the drawing (FIG. 1) to produce the movement of the gun towards and away from the part being painted. The device 26 has a roller 84 rolling on the cam 82, which roller is mounted on the cantilever arm 24 so as to be freely rotatable on a pin parallel to the swivel rod 28. The cam 82 therefore controls the cantilever arm 24 by a positive connection established by a tension coil spring 88 connected to the frame 10 and cantilever arm 24 so that the roller 84 is held against the cam 82.

The swivel rod 28 is rigid and extends out of both ends of the cantilever arm 24 and carries the spray gun 30 which is arranged transversely as shown. The swivel rod 28 has two parts of unequal length, the longer part 28.1 extending transversely through the yoke 78 and being rigidly but releasably connected to the shorter part 28.2 by a sleeve 28.3 in the cantilever arm 24. The sleeve 28.3 has an L-shaped crank arm 90 which can be acted upon by a ram formed by the enlarged end of a piston rod 92 of a pneumatic cylinder 94. Thus when the cantilever arm 24 is at its lower reversing point, the swivel rod 28 can be rotated so that the spray gun 30 is turned towards the ground for cleaning. The cylinder 94 is a single acting cylinder and is vertical.

The jet produced by the spray gun 30 may be circular, annular, flat or axial, depending on the gun construction. The gun is moved along the circular arc indicated by the dash dot line in FIG. 1, at a rate of about 1 meter per second so long as the cantilever arm 24 is being deflected.

The mechanical coupling 32 of the swivel rod 28 with the cantilever arm 24 comprises a support rod 100 which is supported by a stationary bearing 96 and connected to the swivel rod 28 by a hinge joint 98, a transmission member 102 which is fixed in its rotation on the swivel rod 28 and acts on the support rod 100, and a torsion coil spring 104. The support bearing 96, which is an L-shaped angle member, is movably adjustable parallel to the axis of the rocking shaft 12 by means of slots and set screws (FIG. 2), and its vertical upwardly directed arm has a horizontal support edge 106 which extends transverse to that axis. The hinge joint 98 comprises a retaining ring 108 which is mounted on the rod part 28.2 projecting from the cantilever arm 24 and which is rigidly connected to the support rod 108 and axially located by a ring 110 and the transmission member 102. The latter comprises a securing ring 112 which is mounted on the rod part 28.2 and has a stud 114 which acts from above on the retaining ring 108 of the support rod 100. The torsion spring 104 is mounted on the rod part 28.2 and one end of it is anchored to and acts on the ring 112 while the other end is anchored to and acts on the cantilever arm 24.

The paint changing device 34 is mounted on the cantilever arm 24 near the spray gun 30 but in no way obstructs rotation of the swivel rod 28. Its supply tubes 116, inside the cantilever arm 24, emerge from the arm to enter the housing 74 close to the rocking shaft 12. The paint changing device 34 and its supply tubes 116 are not features of the invention and are only shown in outline in FIG. 2.

As will be understood, the apparatus is so arranged that if the sides are reversed, so that all parts of the apparatus are mirrored on the other side of the vertical plane 118 (indicated by the dash dot line in FIG. 2), the apparatus can still be built up of the same components, so that they can be used selectively for constructing either a left-sided or a right-sided automatic side sprayer.

The mode of operation of the preferred embodiment will now be described. As a preliminary step, the whole apparatus is moved towards the plane 118 in a direction perpendicularly thereto until the spray gun 30 is at the required distance from the part to be painted, which is moved horizontally past the apparatus in the plane 118 at a constant speed which is substantially less than that of the gun.

Before the part to be painted begins to pass the gun 30, the paint supply and the electric motor 16 are switched on. The cantilever arm 24 then swivels from its inclined position at its lower reversing point through its horizontal mid-position to its inclined position at the upper reversing point, the gun 30 meanwhile being pivoted about an axis at right angles to the axis of the shaft 12 and to the swivel rod 28 by the cam 82. This axis about which the spray gun pivots is determined by the trunnion pins 80.1 and 80.2. At the same time, the gun 30 together with the swivel rod 28 rotates about the axis of the latter because the retaining ring 108 of the rod 100 which is supported on the bearing 96 entrains the pin 114 which in turn rotates the swivel rod 28 by way of the securing ring 112, so that the lightly tensioned torsion spring 104 is progressively put under tension. As the gun 30 moves downwards it pivots about the intersecting axis with sign reversed. The same also applies to the rotation of the swivel rod 28, which is turned back by the progressively relaxing torsion spring 104 by way of the securing ring 112.

After the part being painted has moved past the gun 30, the motor 16 is switched off when the cantilever arm has reached its lower reversing point, whereupon the pneumatic cylinder 94, which directs the gun 30 towards the ground, is operated so that the gun can be cleaned. This cleaning is carried out by the paint changing device 34 which may be required to supply a different colour to the gun during the next painting operation.

What I claim is:

1. Apparatus for painting parts of large surface area, the apparatus having a spray gun movable to and fro, and also rotatable, relative to a part to be painted, characterized in that the gun is carried by a swivel member rotatably mounted by a cantilever arm which is mounted for rocking motions about first and second axes, one at right angles to the other, and the swivel member and gun being rotatable about a swivel axis which is at right angles to both the first and second axes, the swivel member is an elongated rod parallel to the cantilever arm, the arm being mounted on a rockable shaft, the axis of which is said first axis, the spray gun being mounted on the free end of the swivel rod, (i) a positively actuatable cam control produces rocking motion of the cantilever arm about the second axis; (ii) a mechanical coupling couples the swivel rod to the cantilever arm so that rotation of the spray gun is derived from the motion of the cantilever arm about the first axis, which motion moves the spray gun to and fro and is substantially independent of the movement about the second axis which moves the spray gun backwards and forwards, an electric motor with a shaft which drives the rockable shaft via a cam mechanism.

2. Apparatus according to claim 1 characterised in that the cam mechanism comprises a driven cam disc and a positively actuated roller lever which is fixed to the rockable shaft.

3. Apparatus according to claim 2 characterised in that the cam disc is replaceable and positively controls the roller lever whose roller is held against the circumference of the disc by the torque of the rockable shaft produced by the weight of the cantilever arm.

4. Apparatus according to claim 1 further comprising a reduction gearing between the motor shaft and the cam mechanism.

5. Apparatus according to claim 4 characterised in that the reduction gearing is a belt drive and/or a gear transmission.

6. Apparatus according to claim 5 characterised in that the belt drive includes a change speed gear with several driving and driven pulleys.

7. Apparatus for painting parts of large surface area, the apparatus having a spray gun movable to and fro, and also rotatable, relative to a part to be painted, comprising a cantilever arm which is mounted for rocking motions about first and second axes, one at right angles to the other, a swivel rod carries the spray gun, said swivel rod being at elongated rod parallel to said cantilever arm, the spray gun being mounted on a free end of the swivel rod, said swivel rod being rotatably mounted by said cantilever arm, said swivel rod and said gun being rotatable about a swivel axis which is at right angles to both said first and second axes.

a rockable shaft, said shaft being rockable about its own axis, said cantilever arm being mounted on said rockable shaft, the axis of said rockable shaft constituting said first axis, means comprising a positively actuatable cam control for producing rocking motion of the cantilever arm about said second axis, means comprising a mechanical coupling for coupling the swivel rod to said cantilever arm so that rotation of the spray gun is derived from the motion of the cantilever arm about the first axis, which motion moves the spray gun to and fro and is substantially independent of the movement about said second axis which moves the spray gun backwards and forwards, the gun being rotatable so as to perpendicularly orient the gun relative to the part to be painted.

8. The apparatus as set forth in claim 7, further comprising an electric motor with a shaft which drives the rockable shaft via a cam mechanism.

9. Apparatus according to claim 8, characterized in that the cam mechanism comprises a driven cam disc and a positively actuated roller lever which is fixed to the rockable shaft.

10. Apparatus according to claim 9, characterized in that the cam disc is replaceable and positively controls the roller lever whose roller is held against the circumference of the disc by the torque of the rockable shaft produced by the weight of the cantilever arm.

11. Apparatus according to claim 8, further comprising a reduction gearing between the motor shaft and the cam mechanism.

12. Apparatus according to claim 11, characterized in that the reduction gearing is a belt drive and/or a gear transmission.

13. Apparatus according to claim 12, characterized in that the belt drive includes a change speed gear with several driving and driven pulleys.

14. Apparatus according to claim 7, wherein said to and fro movement is an up and down movement, the rockable shaft is horizontally disposed with an orientation corresponding to the intended up and down movement.

15. Apparatus according to claim 7, further comprising a fork joint means for pivoting the cantilever arm to the rockable shaft, a trunnion bearing of which joint is fixed to one end of the rockable shaft, and a pin of the joint constituting means for connecting the cantilever arm to the bearing.

16. Apparatus according to claim 7, wherein said to and fro movement is an up and down movement.

17. Apparatus according to claim 7, wherein said positively actuated cam control comprises a replaceable, stationary cam which extends along a circular arc about the first axis and a rolling body which rolls on the stationary cam and which is mounted on the cantilever arm to be freely rotatable about an axis parallel to the swivel rod.

18. Apparatus according to claim 7 wherein the swivel rod has a crank arm, a piston rod of a ram acts on said crank arm when the cantilever arm is at its lower reversing point, the piston rod thereby directing the spray gun downward about the swivel axis for cleaning.

19. Apparatus according to claim 7, further comprising a paint changing device is disposed near an end of the cantilever arm which is adjacent the spray gun, supply pipes for the changing device emerging from the cantilever arm near the rockable shaft.

20. Apparatus according to claim 7 characterised in that the stationary cam positively controls the cantilever arm, in that the rolling body is a roller, and in that the positive connection is established by a spring between the cantilever arm and the frame of the apparatus.

21. Apparatus according to claim 7, wherein said mechanical coupling comprises a stationary support member and a support rod supported by said stationary support member and connected to the swivel rod through a hinge joint, a transmission member non-rotatably mounted on the swivel rod and acts on the support rod, and a torsion spring between the cantilever arm and the transmission member.

22. Apparatus according to claim 21 characterised in that the support member is displaceable parallel to the first axis and has a line of support extending transverse to the first axis.

23. Apparatus according to claim 22 characterised in that the line of support is a non-rectilinear curve.

24. Apparatus according to claim 21 wherein the hinge joint has a retaining ring seated on the swivel rod and is rigidly connected to the support rod and is axially secured by a tension ring and the transmission member.

25. Apparatus according to claim 21 wherein the transmission member has a securing ring which is mounted on the swivel rod and has a parallel transmission pin.

26. Apparatus according to claim 21 wherein the torsion spring is a coil spring mounted on the swivel rod and the ends of which act on the transmission member.

27. Apparatus according to claim 21 wherein another end of the swivel rod which is remote from the spray gun extends out of the cantilever arm, and the hinge joint, the transmission member, and the torsion spring are disposed on said another end of the swivel rod.

28. Apparatus according to claim 21, wherein said torsion spring is a coil spring mounted on said swivel rod and the ends of which act on said cantilever arm.

29. Apparatus for painting parts of large surface area, the apparatus having a spray gun movable to and fro, and also rotatable, relative to a part to be painted, comprising a cantilever arm which is mounted for rocking motions about first and second axes, one at right angles to the other, a swivel rod carries the spray gun, said swivel rod being an elongated rod parallel to said cantilever arm, the spray gun being mounted on a free end of the swivel rod, said swivel rod being rotatably mounted by said cantilever arm, said swivel rod and said gun being rotatable about a swivel axis which is at right angles to both said first and second axes, a rockable shaft, said shaft being rockable about its own axis, said cantilever arm being mounted on said rockable shaft, the axis of said rockable shaft constituting said first axis, means comprising a positively actuatable cam control for producing rocking motion of the cantilever arm about said second axis, rotation of the spray gun being derived from the motion of the cantilever arm about the second axis, which motion moves the spray gun backwards and forwards and is substantially independent of the motion of said cantilever about said first axis which moves the spray gun to and fro, the gun being rotatable so as to perpendicularly orient the gun relative to the part to be painted.

* * * * *